US008145491B2

(12) United States Patent
Hamza et al.

(10) Patent No.: US 8,145,491 B2
(45) Date of Patent: Mar. 27, 2012

(54) TECHNIQUES FOR ENHANCING THE PERFORMANCE OF CONCATENATIVE SPEECH SYNTHESIS

(75) Inventors: Wael Mohamed Hamza, Tarrytown, NY (US); Michael Alan Picheny, White Plains, NY (US)

(73) Assignee: Nuance Communications, Inc., Burlington, MA (US)

( * ) Notice: Subject to any disclaimer, the term of this patent is extended or adjusted under 35 U.S.C. 154(b) by 3215 days.

(21) Appl. No.: 10/208,453

(22) Filed: Jul. 30, 2002

(65) Prior Publication Data

US 2004/0024600 A1 Feb. 5, 2004

(51) Int. Cl.
*G10L 13/06* (2006.01)

(52) U.S. Cl. ..... 704/268; 704/267; 704/258; 704/207

(58) Field of Classification Search ..... 704/258–269
See application file for complete search history.

(56) References Cited

U.S. PATENT DOCUMENTS 5,327,498 A 7/1994 Hamon ..... 381/51
5,524,172 A 6/1996 Hamon ..... 395/2.77
5,787,398 A * 7/1998 Lowry ..... 704/268
5,915,237 A * 6/1999 Boss et al. ..... 704/270.1
5,933,805 A * 8/1999 Boss et al. ..... 704/249
6,073,100 A * 6/2000 Goodridge, Jr. ..... 704/258
6,101,470 A * 8/2000 Eide et al. ..... 704/260
6,405,169 B1 * 6/2002 Kondo et al. ..... 704/258
6,499,014 B1 * 12/2002 Chihara ..... 704/260
6,975,987 B1 * 12/2005 Tenpaku et al. ..... 704/258

* cited by examiner

*Primary Examiner* — Qi Han
(74) *Attorney, Agent, or Firm* — Wolf, Greenfield & Sacks, P.C.

(57) ABSTRACT

When pitch of a speech segment is being modified from a current pitch to a requested pitch, and the difference between these is relatively large, a pitch modification algorithm is used to modify the pitch of the speech segment. When the difference between current and requested pitches is relatively small, the pitch of the speech segment is not modified. After one or the other speech modification techniques are used, then the resultant modified speech segment is overlapped and added to previously modified speech segments. A modification ratio is determined in order to quantify the difference between the current and requested pitches for a speech segment. The modification ratio is a ratio between the requested and current pitches. Low and high ratio thresholds are used to determine when pitch is being modified to a predetermined high degree, and whether pitch of the speech segment will or will not be modified.

1 Claim, 7 Drawing Sheets

TECHNIQUES FOR ENHANCING THE PERFORMANCE OF CONCATENATIVE SPEECH SYNTHESIS

FIELD OF THE INVENTION

This invention relates to speech synthesis from text or concepts and, more specifically, the invention relates to concatenative speech synthesis.

BACKGROUND OF THE INVENTION

Concatenative speech synthesis is commonly used in text-to-speech and concept-to-speech software devices. In text-to-speech devices, text is converted to speech. In concept-to-speech devices, a concept (such as "What is the stock price for X company today?") is converted to speech.

In concatenative speech synthesis, speech is generated by concatenating stored speech segments. The stored speech segments are selected to conform to the text or concept being synthesized, then the speech segments are concatenated to create a synthesized utterance. Prior to concatenation, acoustic features of the stored speech segments are modified to make the speech segments match requested features of the synthesized utterance. These features comprise duration, energy, fundamental frequency (called "pitch" herein), and spectral envelope of the speech segments. The features are determined by modules in the concatenative speech synthesis system, and are determined in such a way as to make the resultant speech sound relatively natural.

There are many algorithms to modify the pitch of speech segments. Among these algorithms are the parametric techniques, like linear predictive coding techniques. These techniques are generally considered to have poor output quality. Most popular concatenative speech synthesizers use time domain techniques because of their simplicity and high quality output. For example, U.S. Pat. Nos. 5,327,498 and 5,524,172, the disclosures of which are hereby incorporated by reference, describe a time domain technique that is commonly used in concatenative speech synthesizers. However, these time domain techniques can produce poor quality when the pitch for a speech segment is changed to a high degree, especially at low sampling rates where pitch basically has a larger impact.

To overcome the time domain technique problems, more complex algorithms have been used to modify the pitch of the speech segments. For example, an algorithm to perform the pitch modification in the frequency domain rather than the time domain has been used. Also great success has been achieved by developing algorithms that use a sinusoidal representation of the speech signal. Results show that those techniques outperform, in terms of speech output as judged by human tests, the time domain methods and leave room for further research and enhancement while the time domain methods do not.

However, the later algorithms are known for their computational complexity, which makes them impractical to use in commercial concatenative speech synthesizers. To overcome this problem, i.e., to enhance the performance of the speech synthesizers while using these techniques, fast algorithms for each particular technique were introduced. For example, many realizations of fast Fourier transform algorithms have been used to reduce the complexity of the frequency domain techniques, while quick methods for calculating a cosine function are used in techniques using the sinusoidal representation of speech signals. Nonetheless, the computation complexity of the later algorithms is still high, as is the time required to execute the algorithms.

Thus, even though improvements in concatenative speech synthesis have been made, there still exists a need for increasing the speed of concatenative speech synthesis while maintaining output voice signal quality.

SUMMARY OF THE INVENTION

The present invention improves over conventional techniques by determining how much pitch of a speech segment is being modified and performing different speech segment modification techniques based on a value of pitch modification.

In one aspect of the invention, when pitch of a speech segment is being modified from a current pitch to a requested pitch, and the difference between the current and requested pitches is relatively large, then a pitch modification algorithm is used to modify the pitch of the speech segment. Illustratively, the speech segment is first windowed prior to having the pitch modification algorithm modify the pitch of the speech segment. This type of speech segment modification technique thus provides both windowing and pitch modification. When the difference between current and requested pitches is relatively small, the pitch of the speech segment is not modified. The speech segment modification technique then only corresponds, illustratively, to windowing of the speech segment. After one or the other speech modification techniques are used, then the resultant modified speech segment is overlapped and added to a previously modified speech segment.

In another aspect of the invention, a modification ratio is determined in order to quantify the difference between the current and requested pitches for a speech segment. The modification ratio is a ratio between the requested and current pitches. Additionally, low and high ratio thresholds are used to determine when pitch is being modified to a predetermined high degree, and whether pitch of the speech segment will or will not be modified.

These and other objects, features and advantages of the present invention will become apparent from the following detailed description of illustrative embodiments thereof, which is to be read in connection with the accompanying drawings.

DETAILED DESCRIPTION OF PREFERRED EMBODIMENTS

Aspects of the present invention speed processing during concatenative speech synthesis by selecting between two or more speech segment modification techniques. The speech segment modification techniques accept information about a current speech segment and produce a modified speech segment suitable for use in an overlap-add technique. In one embodiment, there are two speech segment modification techniques used, one technique that does modify pitch of the current speech segment and another technique that does not modify pitch of the current speech segment. A criterion used for selection of one of the two techniques is how much the pitch is being modified for the current speech segment. To determine the pitch modification, the original pitch of the speech segment is compared to the requested pitch for the speech segment. If the pitch of the current speech segment is being modified to a predetermined large amount, relative to the original pitch of the speech segment, then a relatively complex pitch modification algorithm is used to modify the pitch. Such complex pitch modification algorithms are generally performed in the frequency domain. When the pitch is being modified to a lesser degree, the pitch of the current speech segment is not modified. The present invention thus provides for an overall increase in throughput and speed with no apparent decrease in speech quality.

Figure 1:
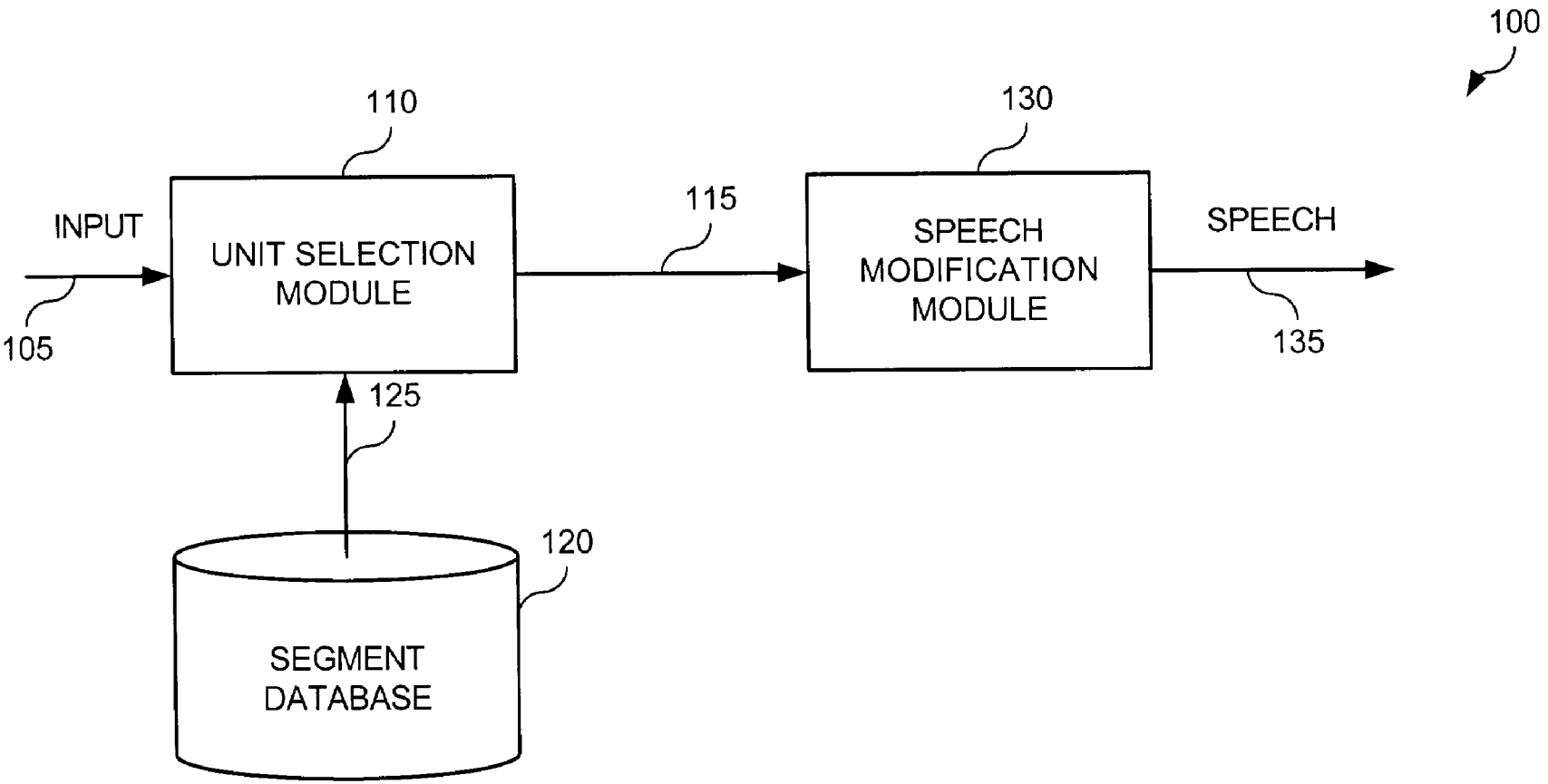
FIG. 1 is an overall block diagram of a concatenative speech synthesizer, in accordance with one embodiment of the present invention.

Referring now to FIG. 1, a block diagram is shown of concatenative speech synthesis system 100 that generates speech by concatenating stored speech segments after modifying their acoustical features. The input information to this system 100 comes via input 105. This input 105 is generated from preceding modules in a Text-to-Speech or Concept-to-Speech system, which is generally where the concatenative speech synthesis system 100 is used. This input 105 represents information about the requested utterance. This input 105 comprises a set of unit identification sequences along with their acoustic features such as duration, energy and pitch information. Using this input, the unit selection module 110 accesses a segment database 120 that stores units and selects, via element 125, a sequence of stored units that have the same input unit identities. The "units" could be any concatenative unit that could be used to construct the speech. For instance, words, syllables, diphones, phones, and sub-phonetic units are examples of such units. The present invention can work with any type of concatenative units. In fact, the present invention is suitable for use with any type of segment of speech, no matter how large or small. The term "speech segments," thus, encompasses all concatenative units. The segment database 120 could contain few or many examples of each speech segment. The selected unit sequence as well as the input acoustic features or a modified version of the acoustical features are passed to the speech modification module 130 via 115. The selected unit sequence is used by unit selection module 110 to select appropriate speech segments from segment database 120. The speech modification module 130 modifies the acoustic features of the given speech segments, corresponding to the unit sequences, to the given acoustic features and generates the output speech 135.

The present invention described herein addresses pitch modification of a speech segment. Pitch modification takes place, as described in more detail below, in speech modification module 130. The present invention beneficially operates in a pitch synchronous fashion. For that reason, information about the pitch marks of a stored speech segment should be given to the pitch modification techniques of the present invention. This pitch mark information could be extracted using a hardware device during the speech recordings, calculated directly from the speech signal, or even annotated manually. These pitch marks appear with pitch period and are aligned to the glottal closure instants, which are the instants the vocal folds are completely closed.

The present invention operates in a pitch synchronous rate and could be described as follows. In one embodiment, for a given speech segment to be pitch modified, the algorithm goes through the pitch marks one after another. For each pitch mark, the original pitch value of the given segment at this mark is obtained from the pitch marks information. Also the value of the requested pitch is obtained from the given pitch contour. A pitch modification ratio is obtained by dividing the requested pitch value by the original pitch value. If the resulting ratio lies between two predetermined ratio thresholds, the pitch will not be modified, i.e. the pitch modification will be bypassed. Otherwise, the speech signal is passed to a pitch modification algorithm. It is also anticipated that more than one pitch modification technique could be used, so that a faster pitch modification technique is used when the ratio lies between the two predetermined ratio thresholds and a slower pitch modification technique is used when the ratio lies outside the two predetermined ratio thresholds.

Figure 2:
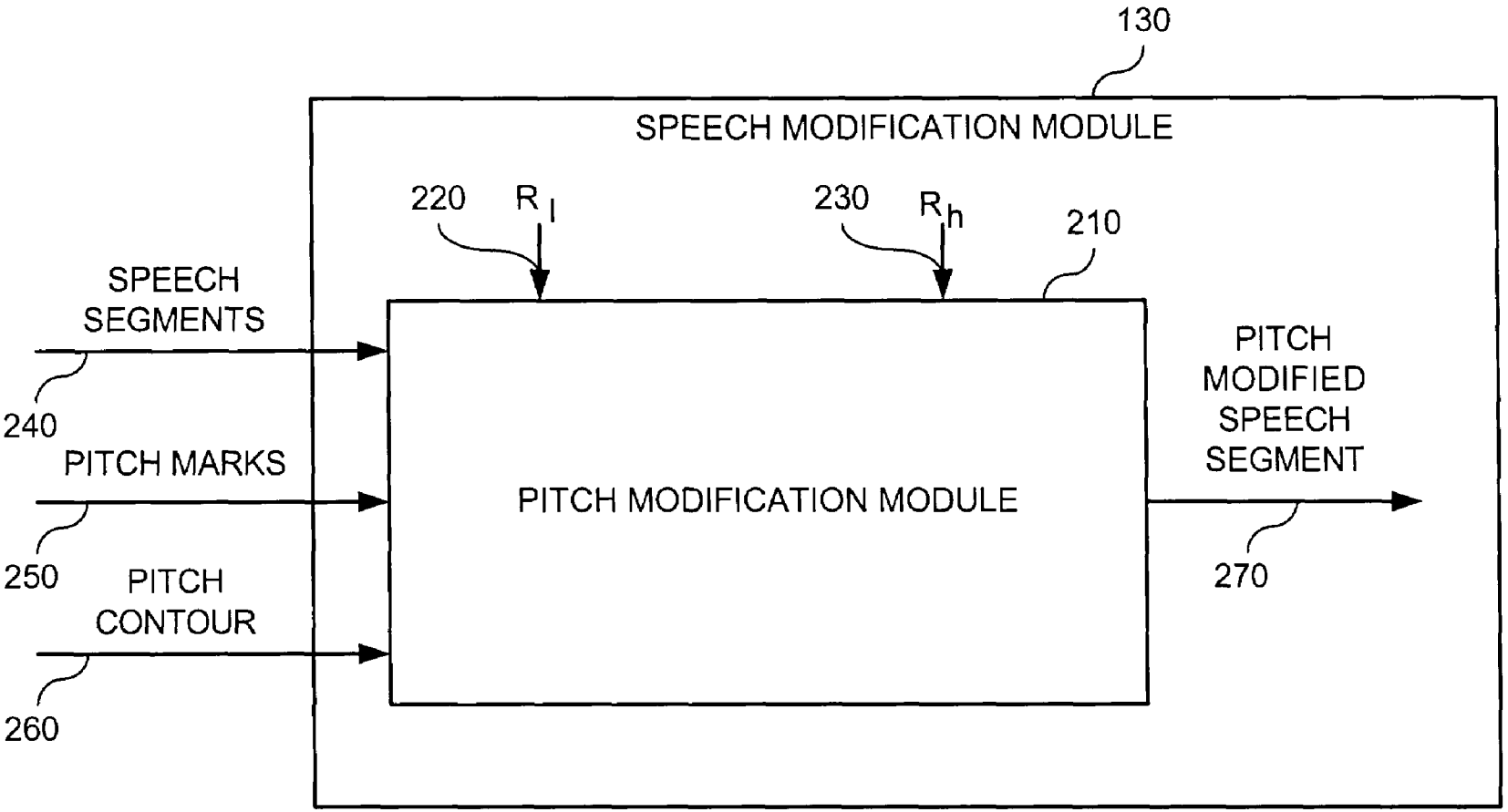
FIG. 2 is a block diagram of a speech modification module in which various inputs and outputs are shown, in accordance with one embodiment of the present invention.

Detailed input and output information to the invention is shown in FIG. 2. The information provided via 115 (see FIG. 1) comprises selected speech segments 240, pitch mark information 250, and a pitch contour 260. The selected speech segments 240 are passed to the pitch modification module 210. The pitch mark information 250 that corresponds to the given speech segments 240 is provided to the pitch modification module 210. Pitch mark information 250 comprises a plurality of location of pitch marks. The requested pitch contour 260, which contains requested pitch information, is given to the pitch modification module 210 so that the pitch modification module 210 can obtain the pitch value at any instant of a given utterance. An utterance generally contains multiple speech segments, and the pitch contour 260 and pitch mark information will contain information for each of the speech segments. The speech segments are operated on by the pitch modification module 210 in a serial fashion.

The two ratio thresholds 220, 230 are given to the pitch modification module 210. These two ratio thresholds will be called $R_l$ and $R_h$ denoting the low and high ratio thresholds, respectively. These two ratio thresholds 220, 230 have control over which speech segment modification techniques are chosen. Additionally, because pitch modification is beneficial in certain instances, these two ratio thresholds also have control over quality of the output speech. For instance, it is beneficial to use a complex pitch modification algorithm when the requested pitch is much higher than the original pitch of a speech segment. These two ratio thresholds can therefore be adjusted in order to obtain high quality speech with a minimum amount of processing power.

The two ratio thresholds 220, 230 generally depend on the speaker from which the segment database 120 (see FIG. 1) was made. Different thresholds 220, 230 may be chosen depending on the speech segments in the segment database 120, and the thresholds 220, 230 are beneficially selected by testing a variety of different thresholds 220, 230 for the segment database 120 being used. To select thresholds 220, 230, human testers are used to listen to speech produced by speech modification module 130 when various thresholds 220, 230 are used. The thresholds 220, 230 that produce the best speech with the lowest amount of processing are beneficially selected. Generally, this means that the thresholds 220, 230 are chosen so that the largest difference between thresholds (i.e., $R_h - R_l$) causes the best speech as compared to running all speech through a complex speech processing algorithm.

The pitch modification module 210 modifies the pitch of one or more of the speech segments 240, by using the pitch mark information 250, pitch contour 260, and ratio thresholds 220, 230. The pitch modification module 210 generates a pitch modified speech segment 270 as output. It should be noted speech modification module 130 may perform additional processing on the pitch modified speech segment 270, if desired.

Figure 3:
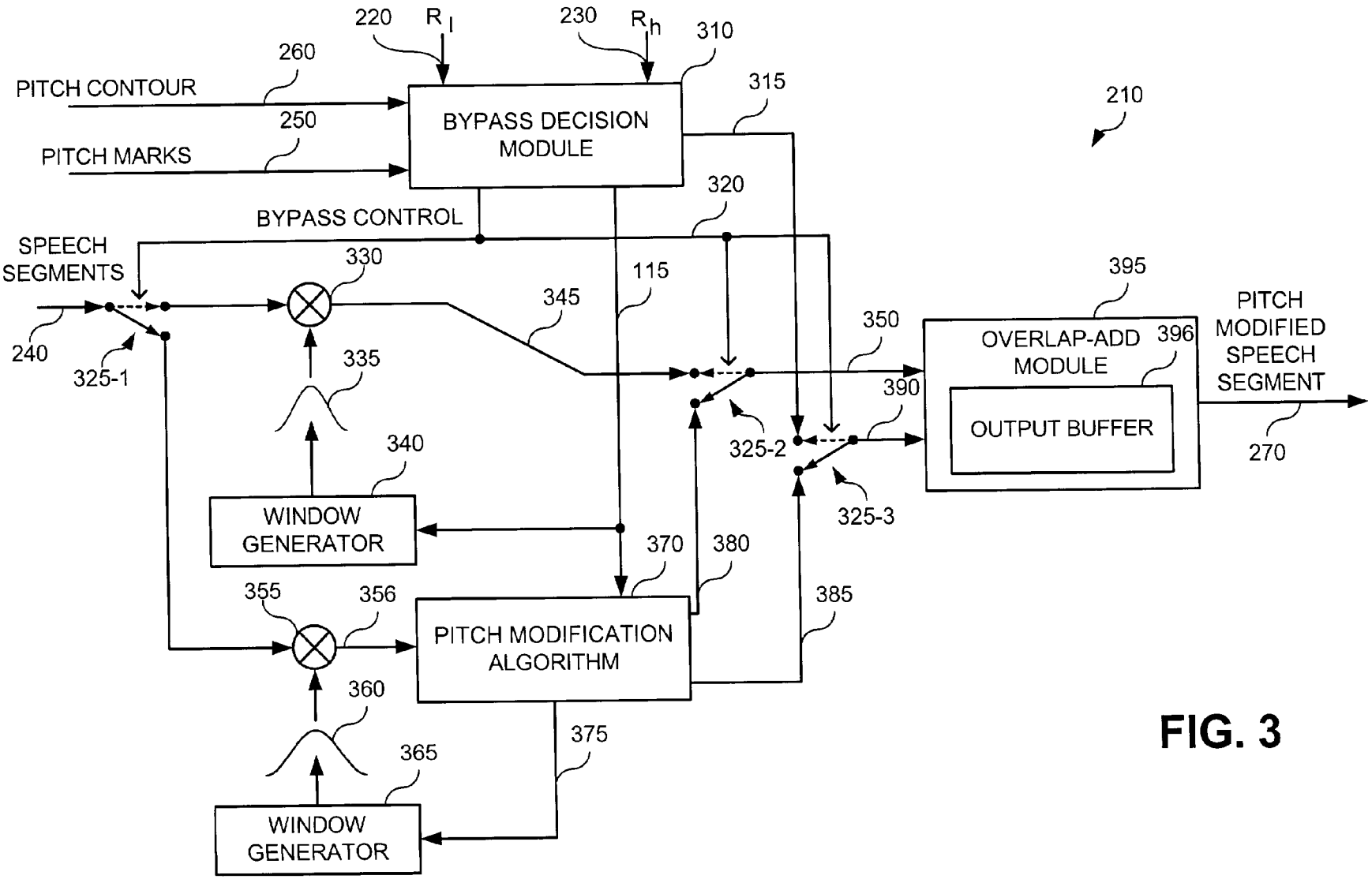
FIG. 3 is a block diagram illustrating an exemplary pitch modification module in accordance with one embodiment of the present invention.

FIG. 3 shows a more detailed view of an exemplary pitch modification module 210. Pitch modification module 210 comprises a bypass decision module 310, two multipliers 330, 355, two window generators 340, 365, a pitch modification algorithm 370, an overlap-add module 395, and three switches 325-1, 325-2, and 325-3 (collectively, "switches 325"). Pitch modification algorithm 370 is, in this example, an algorithm that performs pitch modification in the frequency domain. The overlap-add module comprises an output buffer 396. The input speech segments 240 are applied to switch 325-1. As mentioned above, pitch mark information 250 is also given, where the pitch mark information 250 denotes the location of pitch marks in the given speech segment. The pitch mark information 250 is provided to the bypass decision module 310. The requested pitch information is given in pitch contour 260, which is provided to bypass decision module 310. For each pitch mark in the given pitch mark information 250, the bypass decision module 310 calculates the pitch ratio at this mark, R, by dividing the requested pitch value given in pitch contour 260 by the original pitch value extracted from the given marks in pitch mark information 250. That is $$R = \frac{P_r}{P_o},$$

where $P_r$ and $P_o$ are the requested and the original pitch values, respectively. The resulting ratio is then compared to the low and high ratio thresholds 220, 230, $R_l$ and $R_h$, respectively. These two thresholds 220, 230 are given to the bypass decision module. If the ratio R lies between $R_l$ and $R_h$, the bypass decision is taken and the switches 325 are switched to the dashed positions. These positions, in this example, bypass the pitch modification algorithm 370, and no pitch modification is performed. If the ratio R lies outside $R_l$ and $R_h$, the bypass decision is not taken and the switches 325 are switched to the solid positions. These positions, in this example, enable the pitch modification algorithm 370, and pitch modification is performed. Thus, in this example, two different paths are chosen for speech segments. Which path is chosen depends on how much the requested pitch differs from the original pitch for the selected speech segment.

The switch command is given to these switches via bypass control 320. With switch 325-1 in the dashed position, the input speech is passed to the multiplier 330 and is multiplied by a window function 335. Although any window function 335 could be used, it is beneficial to use a Hanning window. The window function 335 is generated by the window generator 340, which generates a window around the pitch mark. The window generator 340 receives pitch mark information 115 from the bypass decision module 310. The resulting windowed signal 345 is passed to the overlap-add module 395, which is coupled to switch 325-2 currently in the dashed position, and through connection 350. Thus, one speech segment modification technique windows a speech segment and produces a modified speech segment that is windowed signal 345. The overlap-add module 395 overlaps and adds this windowed signal 345 to the output buffer 396, where the windowed signal 345 is centered on an instant called the synthesis time instant. The synthesis time instant is then incremented by a time increment that is given to the overlap-add module via 315, which is coupled to switch 325-3 currently in the dashed position, and via connection 390. This time increment is provided by the bypass decision module 310, which extracts it from the given pitch marks. This value is equal to the time difference between the next pitch mark and the current pitch mark, as shown in more detail in FIG. 4.

If the resulting pitch modification ratio R is lower than the low pitch modification ratio $R_l$ or higher than the high pitch modification ratio $R_h$, a "non-bypass" decision is taken by the bypass decision module 310 and the bypass decision module 310 moves, through bypass control 320, the switches 325 to the solid positions. With switch 325-1 in the solid position, the speech segment is then passed to multiplier 355 and is multiplied by a window function 360. The window function 360 is generated from the window generator 365 that takes window location and window information from the pitch modification algorithm 370 via 375. Some exemplary pitch modification algorithms are described in Moulines and Laroche, "Non-Parametric Techniques for Pitch-Scale and Time-Scale Modification of Speech," Speech Communication 16 (2) (1995), the disclosure of which is hereby incorporated by reference. This window function 360 is generated around the pitch mark 115 presented to the pitch modification algorithm 370 and is usually wider than the bypass window function 335. The resulting windowed signal 356 is provided to the pitch modification algorithm and the pitch modified speech segment 380 is passed to the overlap-add module 395 via switch 325-2 (in the solid position) and connection 350. Thus, a second speech segment modification technique involves both windowing a speech segment and modifying the pitch of the speech segment through a pitch modification algorithm 370. As in the bypass case, the overlap-add module 395 overlaps and adds the given modified speech segment 380 to the output buffer 396, where the modified speech segment 380 is centered on the synthesis time instant. In the non-bypass case, the synthesis instant is incremented by the time increment 385 determined by the pitch modification algorithm. The time increment 385 is passed to the overlap-add module 395 through switch 325-3 (in the solid position) and connection 390. This time increment 385 is usually the new pitch value at the current pitch mark but could be different.

Figure 4:
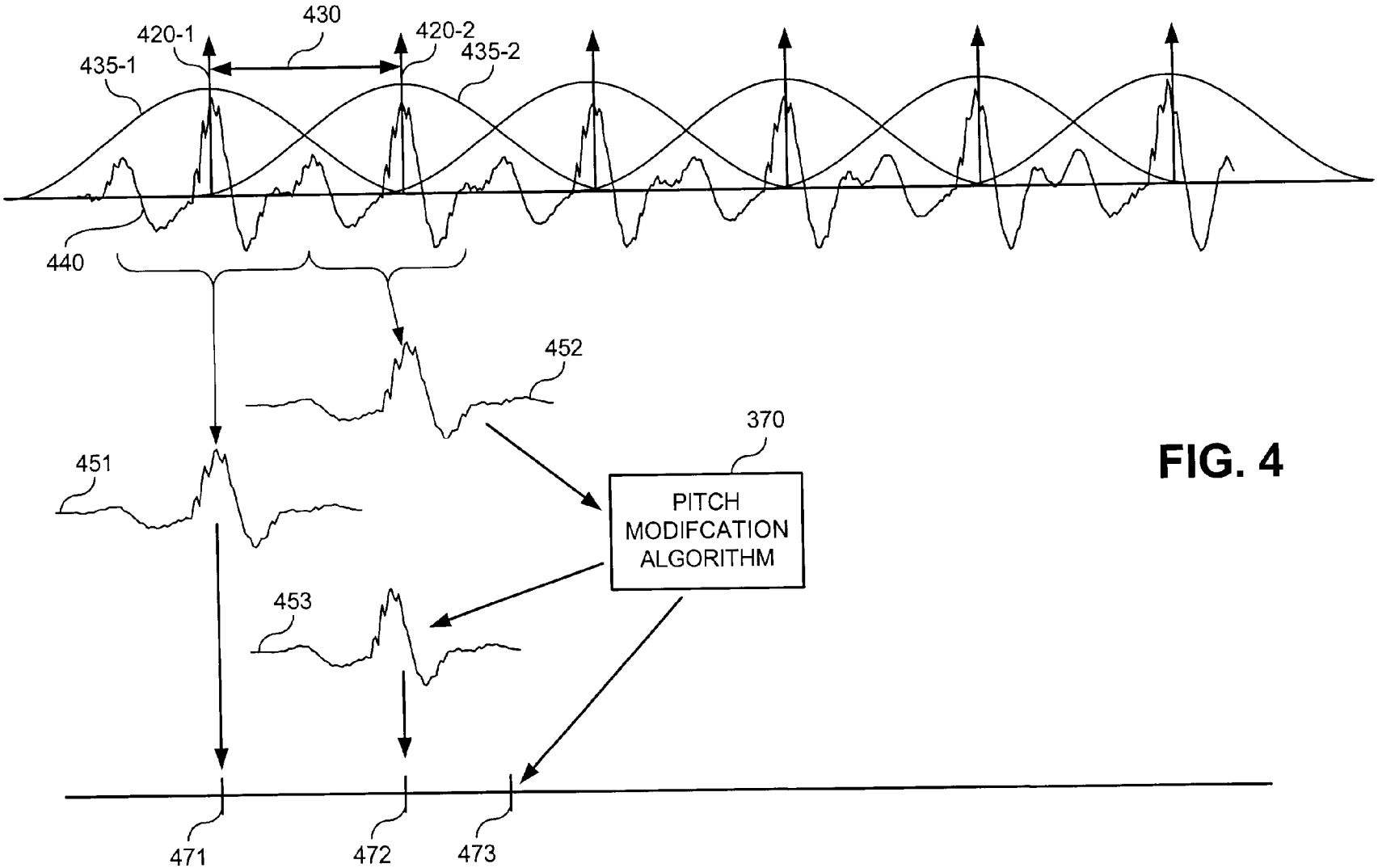
FIG. 4 shows an exemplary representation of the steps taken during pitch modification, in accordance with one embodiment of the present invention.

FIG. 4 shows a schematic diagram of this operation. The figure shows a segment of voiced speech signal 440. This segment is provided as an input to the pitch modification module. As mentioned above, the pitch marks are also given as an input. Consider the pitch mark 420-1. The original pitch value is calculated from the given current pitch mark 420-1 and the next pitch mark 420-2. This original pitch value is shown in the figure as reference 430. Then, the requested pitch value extracted from the requested pitch contour is obtained. The ratio R is then computed as above, and assume that, in this particular case, the bypass decision is taken. The speech signal is then multiplied by the bypass-case window-function 435-1 and the resulting windowed signal 451 (also called a "modified speech segment" herein) is overlapped and added to the output buffer at synthesis time instant 471. The new synthesis time instant is then computed by adding the original pitch value 430 to the old synthesis time instant 471 and the new synthesis time instant is then synthesis time instant 472. For the next pitch mark 420-2, the ratio R is also computed and assume that, in this particular case, the non-bypass decision is taken. The speech segment is then multiplied by the window function 435-2 and the resulting windowed signal 452 is passed to the pitch modification algorithm 370. The pitch modification algorithm 370 generates the modified speech segment 453, which is overlapped and added to the output buffer at synthesis time instant 472. The synthesis time instant is then incremented by the value suggested from the modification algorithm and the new synthesis time instant becomes instant 473. This operation is repeated until the last mark in the given segment is reached. The first synthesis time instant for a given input segment is defined to be the last synthesis time instant that has been calculated for the previous contiguous set of speech segments.

Figure 5A:
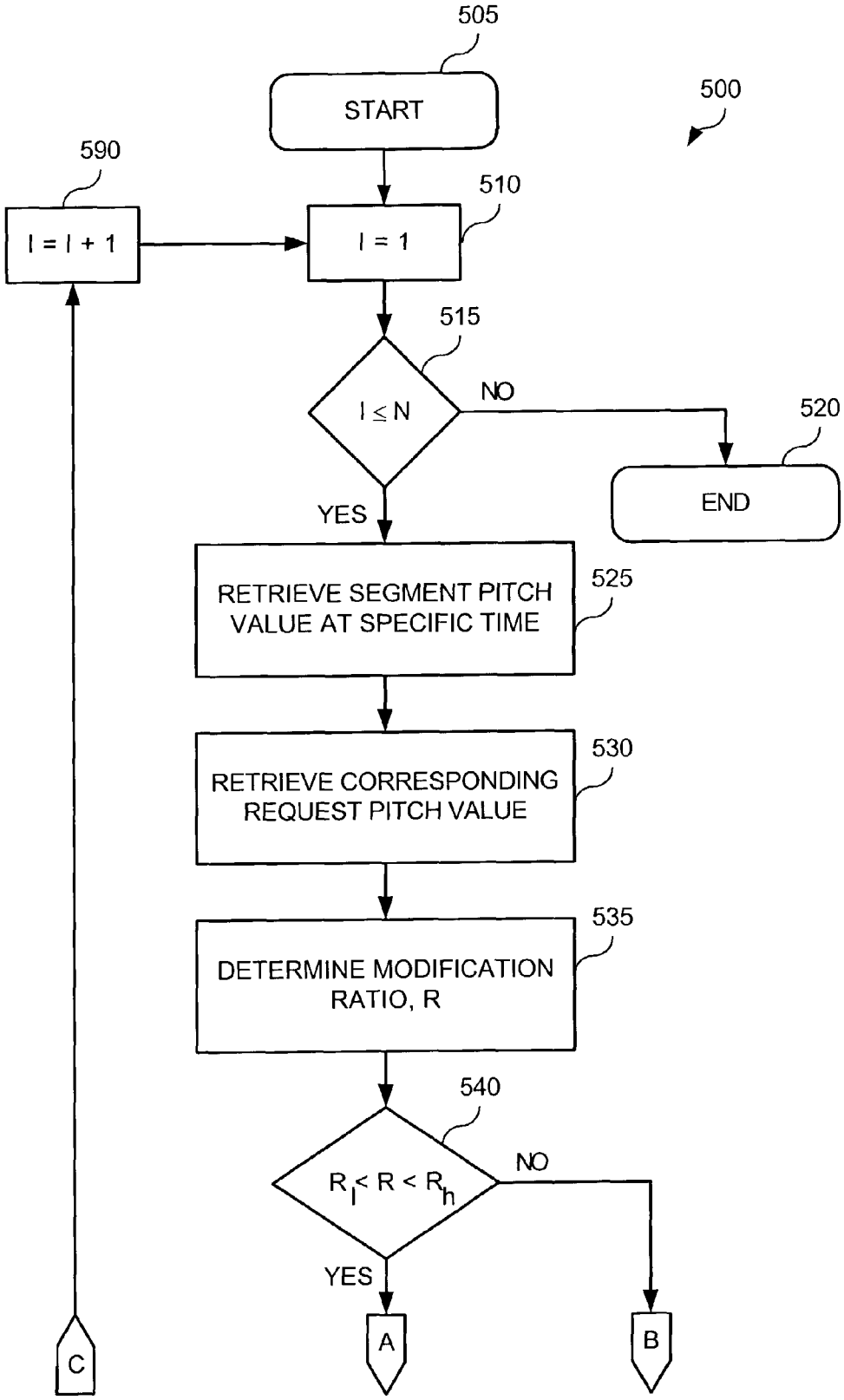
FIGS. 5A and 5B are a flow chart of a method for selectively modifying pitch, in accordance with one embodiment of the present invention.
Figure 5B:
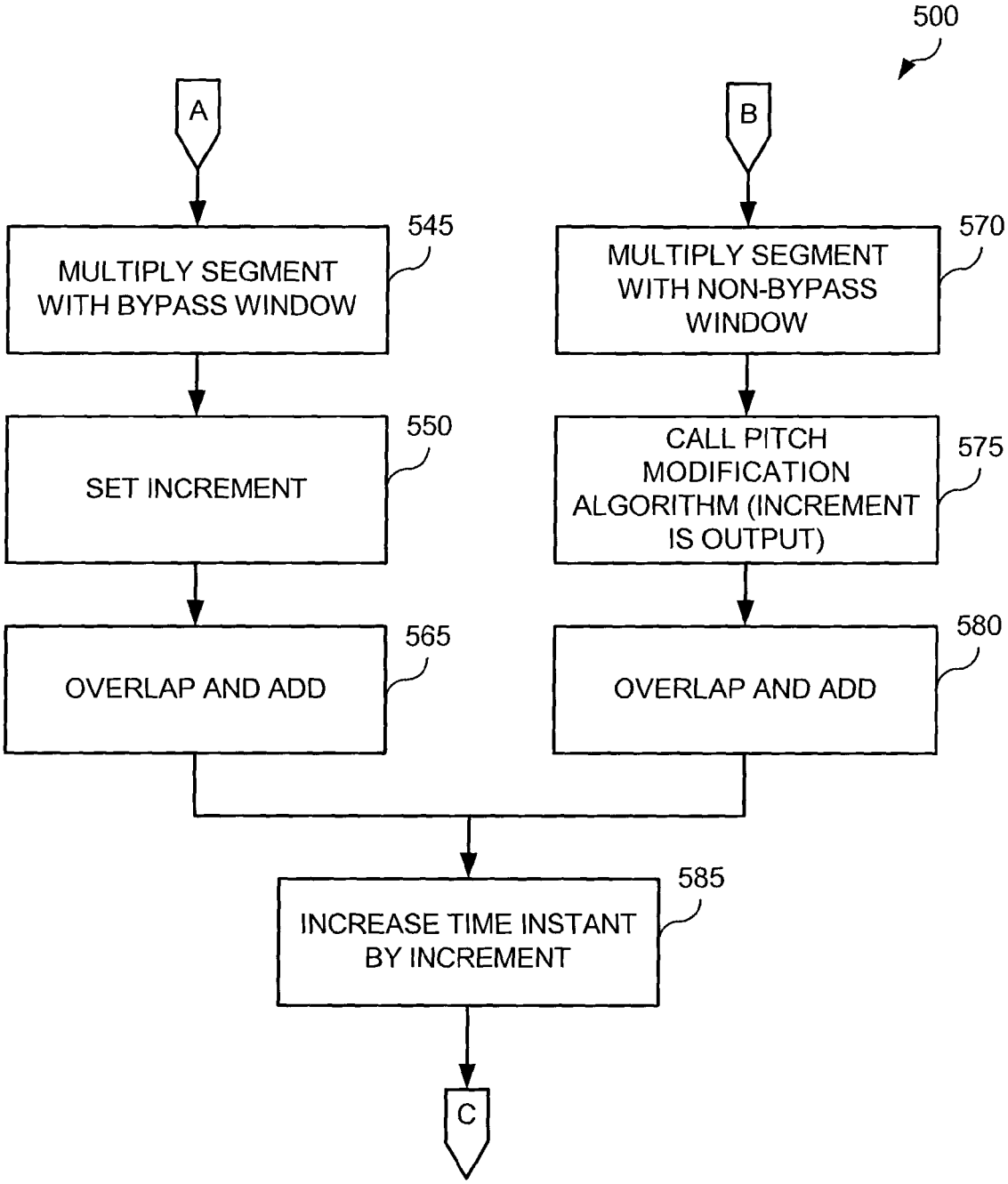

FIGS. 5A and 5B show a flow chart of an exemplary method 500 which selectively modifies pitch. The input to the method 500 comprises the following: (1) a speech segment waveform, comprising a number of speech segments in an order; (2) the pitch marks (marks[1:N]); (3) the requested pitch contour; (4) the low and the high ratio thresholds $R_l$ and $R_h$, respectively; and (5) the starting synthesis time instant, $t_s$, for this segment, where the starting synthesis time instant is calculated from the previous segment.

The output from method 500 will be the output speech that results from overlapping and adding subsequent windowed speech signal. This speech output represents the input speech segments after modifying their pitch contour to the requested pitch contour.

The method begins in step 505, with the inputs as described above. The variable I is set to one in step 510. In step 515, it is determined if I≦N, where N is the number of speech segments in a speech segment waveform. If I>N (step 515=NO), the method ends in step 520 until the next speech segment waveform is received.

If I≦N (step 515=YES), the method continues in step 525. In step 525, a segment pitch value is retrieved at a specific time. In mathematical terms, t=marks[I], and the segment pitch value at this time is called $P_o$. Then, $P_o$=marks[I+1]−marks[I].

In step 530, the corresponding requested pitch value, $P_r$, for this time is retrieved. In step 535, the modification ratio, R, is determined as $R=P_r/P_o$. In step 540, it is determined if the modification ratio is within the low and high ratio thresholds $R_l$ and $R_h$, respectively. If the modification ratio is within the thresholds (step 540=YES), then the speech segment is multiplied by the bypass window (step 545) to create a modified speech segment, $s_b$. The bypass window is centered at marks [I]. A time increment is set in step 550 through the following formula: increment=marks[I+1]−marks[I]. In step 565, the modified speech segment, $s_b$, is overlapped and added to the output buffer of the overlap-add module. Steps 545, 550, and 565 are the "bypass" steps.

If the modification ratio is not within the thresholds (step 540=No), then the speech segment is multiplied by the non-bypass window in step 570 to create a windowed segment, $s_{nb}$. The non-bypass window is centered at marks[I]. In step 575, the pitch modification algorithm is called. The pitch modified algorithm produces a modified speech segment, $s_{nbm}$, and the increment. In step 580, the modified speech segment, $s_{nbm}$, is overlapped and added to the output buffer of the overlap-add module. Steps 570, 575, and 580 are the "non-bypass" steps.

In step 585, the time instant is incremented via the following formula: $t_s=t_s$+increment. In step 590, the variable I is incremented by one. Method 500 continues until all speech segments have been processed.

Figure 6:
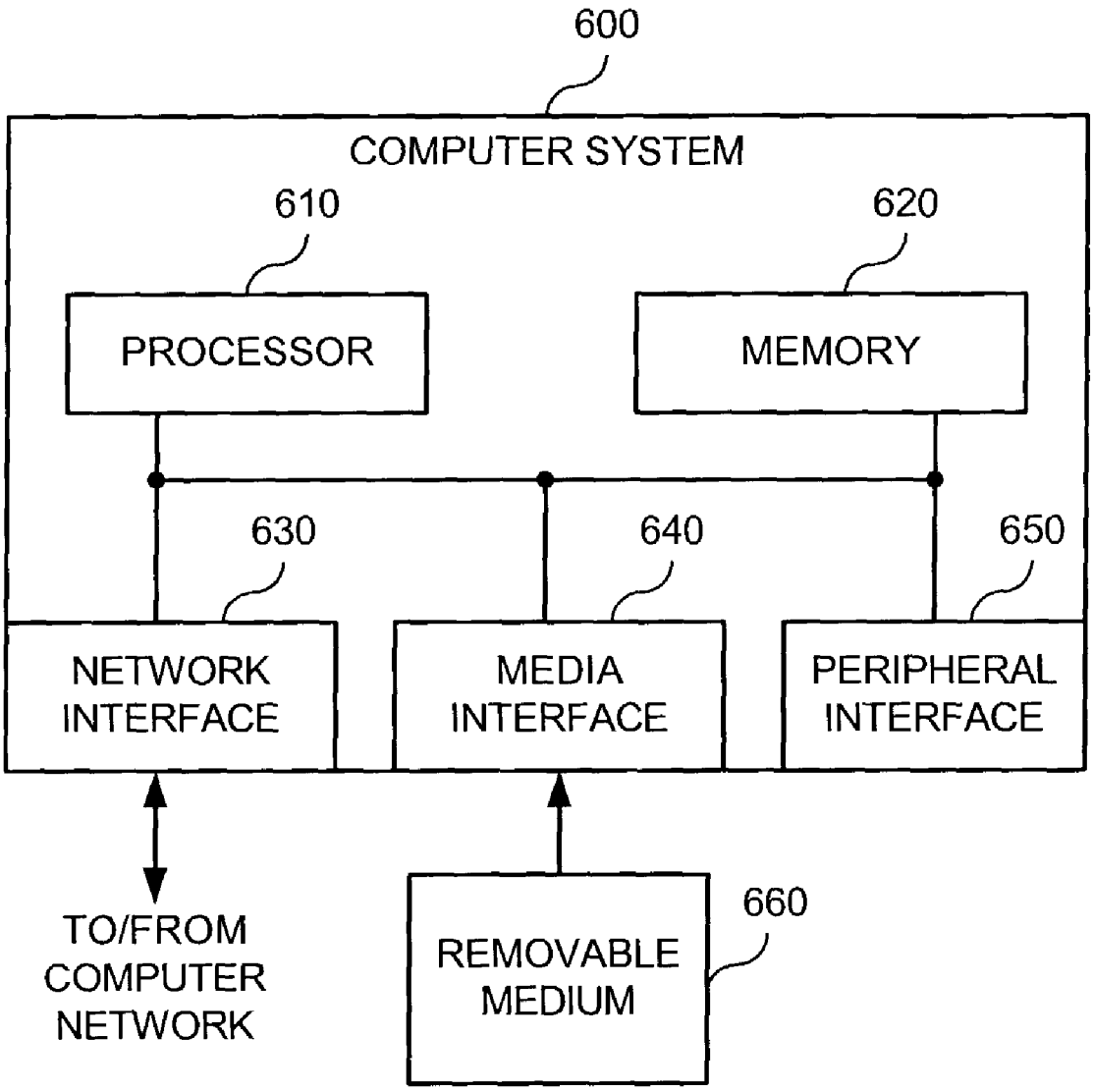
FIG. 6 is a block diagram of a computer system suitable for implementing aspects of the present invention.

Turning now to FIG. 6, a block diagram is shown of a computer system 600 for performing the methods and techniques described in reference to FIGS. 1 through 5. Computer system 600 is shown interacting with a removable medium 660 and a computer network. Computer system 600 comprises a processor 610, a memory 620, a network interface 630, a media interface 640 and a peripheral interface 650. Network interface 630 allows computer system 600 to connect to a network, while media interface 640 allows computer system 600 to interact with media such as a hard drive or removable medium 660. Peripheral interface 650 is an interface that interacts with monitors, mice, keyboards, and other devices to enable human interaction with computer system 600.

As is known in the art, the methods and apparatus discussed herein may be distributed as an article of manufacture that itself comprises a computer-readable medium having computer-readable code means embodied thereon. The computer-readable program code means is operable, in conjunction with a computer system such as computer system 600, to carry out all or some of the steps to perform the methods or create the apparatuses discussed herein. The computer-readable medium may be a recordable medium (e.g., floppy disks, hard drives, optical disks, or memory cards) or may be a transmission medium (e.g., a network comprising fiber-optics, the world-wide web, cables, or a wireless channel). Any medium known or developed that can store information suitable for use with a computer system may be used. The computer-readable code means is any mechanism for allowing a computer to read instructions and data, such as magnetic variations on a magnetic medium or height variations on the surface of a compact disk.

Memory 620 configures the processor 610 to implement the methods, steps, and functions disclosed herein. The memory 620 could be distributed or local and the processor 610 could be distributed or singular. The memory 620 could be implemented as an electrical, magnetic or optical memory, or any combination of these or other types of storage devices. Moreover, the term "memory" should be construed broadly enough to encompass any information able to be read from or written to an address in the addressable space accessed by processor 610. With this definition, information on a network, accessible through network interface 630, is still within memory 620 because the processor 610 can retrieve the information from the network. It should be noted that each distributed processor that makes up processor 610 generally contains its own addressable memory space. It should also be noted that some or all of computer system 600 can be incorporated into an application-specific or general-use integrated circuit. As such, the steps shown in FIGS. 5A and 5B could be "hard coded" or "hard wired" into an integrated circuit or a programmable logic device.

The embodiments described above are merely illustrative and may be changed through techniques known to those skilled in the art. For instance, the embodiments described above determine a pitch modification ratio, R, and use low and high ratio thresholds $R_l$ and $R_h$, respectively. Any suitable techniques for determining how much pitch is being changed from a current pitch to a requested pitch and for setting thresholds based thereon are suitable for use with the present invention.

Furthermore, different speech segment modification techniques may be used in addition to those described. For example, the pitch modification techniques described in U.S. Pat. Nos. 5,327,498, and 5,524,172 (incorporated by reference above) may be used in the "bypass" path of the present invention. A multitude of different pitch modification techniques may be used as the pitch modification algorithm of the present invention. If desired, there could be three paths: (1) a "bypass" path as in the description above, chosen when pitch change is small; (2) a relatively simple pitch modification technique used when pitch change is a medium amount; and (3) a complex pitch modification technique used when pitch change is a large amount. However, the "bypass" and "non-bypass" structure described above can be shown to provide about a 25 percent speed improvement (as compared to solely using a complex pitch modification algorithm) with no discernible change in output speech. Consequently, adding additional pitch modification techniques adds complexity with potentially only minor, if any, improvement in speech quality.

Although illustrative embodiments of the present invention have been described herein with reference to the accompanying drawings, it is to be understood that the invention is not limited to those precise embodiments, and that various other changes and modifications may be made by one skilled in the art without departing from the scope or spirit of the invention.

What is claimed is:

1. A method for use with speech synthesis, comprising the steps of:

determining a value indicating how much pitch is to be modified for a current speech segment; and selecting one of a plurality of speech segment modification techniques based on the value;

wherein the step of determining a value further comprises the steps of:

determining an original pitch value; and determining a requested pitch value;

wherein the step of determining an original pitch value comprises the step of subtracting a next pitch mark from a current pitch mark to determine the original pitch value.

* * * * *